US011791590B2

(12) United States Patent
Klein et al.

(10) Patent No.: US 11,791,590 B2
(45) Date of Patent: Oct. 17, 2023

(54) MAGNETIC CABLE CONNECTION DEVICE AND ADAPATOR

(71) Applicant: Keysight Technologies, Inc., Santa Rosa, CA (US)

(72) Inventors: Dieter Klein, Baden-Wuerttemberg (DE); Christoph Noppel, Baden-Wuerttemberg (DE); Achim Frohnmeyer, Baden-Wuerttemberg (DE); Tze Yang Lim, Penang (MY)

(73) Assignee: KEYSIGHT TECHNOLOGIES, INC., Santa Rosa, CA (US)

( * ) Notice: Subject to any disclaimer, the term of this patent is extended or adjusted under 35 U.S.C. 154(b) by 0 days.

(21) Appl. No.: 17/169,654

(22) Filed: Feb. 8, 2021

(65) Prior Publication Data

US 2021/0336382 A1 Oct. 28, 2021

Related U.S. Application Data

(60) Provisional application No. 63/013,850, filed on Apr. 22, 2020.

(51) Int. Cl.

| | |
|---|---|
| ***H01R 13/62*** | (2006.01) |
| ***H01R 31/06*** | (2006.01) |
| ***H01R 24/46*** | (2011.01) |
| *H01R 103/00* | (2006.01) |

(52) U.S. Cl.

CPC ..... *H01R 13/6205* (2013.01); *H01R 24/46* (2013.01); *H01R 31/06* (2013.01); *H01R 2103/00* (2013.01)

(58) Field of Classification Search

CPC .... H01R 13/6205; H01R 24/46; H01R 31/06; H01R 2103/00; H01F 7/1607; H01F 7/0252; B23Q 3/1543

See application file for complete search history.

(56) References Cited

U.S. PATENT DOCUMENTS 3,812,629 A * 5/1974 Campbell ..... B23Q 3/152 451/364
4,664,796 A * 5/1987 Graham ..... B03C 1/288 210/408
5,000,700 A * 3/1991 Masubuchi ..... H01R 13/7197 333/185

(Continued)

OTHER PUBLICATIONS

German Office Action dated May 4, 2021,with English translation, 3 pgs.

*Primary Examiner* — Thanh Tam T Le

(57) ABSTRACT

A cable connection device includes a cable connector and a magnetic switch. The magnetic switch includes diametrically magnetized first and second annular magnets juxtaposed in a longitudinal direction of the cable connector and extending around a longitudinal axis of the cable connector, and an annular magnetic guide of ferromagnetic material surrounding an outer periphery of the first and second annular magnets. The first annular magnet is fixed relative to the annular magnetic guide, and the second annular magnet is rotatable between ON and OFF positions relative to the annular magnetic guide. In the ON position the first and second annular magnets are magnetically aligned in the longitudinal direction, and in the OFF position the first and second annular magnets are magnetically inverted in the longitudinal direction.

20 Claims, 13 Drawing Sheets

(56) References Cited

U.S. PATENT DOCUMENTS

| | | | | |
|---|---|---|---|---|
| 5,401,175 | A * | 3/1995 | Guimond | H01R 13/6205 439/38 |
| 6,283,767 | B1 * | 9/2001 | Sornes | H01R 11/30 439/100 |
| 7,012,495 | B2 * | 3/2006 | Underwood | H01F 7/04 269/8 |
| 8,183,965 | B2 * | 5/2012 | Michael | H01F 7/04 335/286 |
| 8,350,663 | B1 | 1/2013 | Michael | |
| 8,604,900 | B2 * | 12/2013 | Kocijan | B66C 1/04 336/110 |
| 8,878,639 | B2 * | 11/2014 | Kocijan | H01F 7/0257 335/287 |
| 10,454,208 | B2 | 10/2019 | Johnson et al. | |

* cited by examiner

MAGNETIC CABLE CONNECTION DEVICE AND ADAPATOR

CROSS-REFERENCE TO RELATED APPLICATION

A claim of priority is made to U.S. Provisional Application No. 63/013,850, filed Apr. 22, 2020.

BACKGROUND

Many coaxial connector types are available in the RF (radio frequency) and microwave industry, each designed for a specific purpose and application. The frequency range of a connector is limited by the excitation of a first circular waveguide propagation mode in the coaxial structure. Decreasing the diameter of the outer conductor increases the highest usable frequency. For example, a 3.5 mm connector may have an operating frequency of up 33 GHz, whereas a 1.0 mm connector may have an operating frequency up to 110 GHz.

Performance of all connectors is affected by the quality of the interface for the mated pair. If the diameters of the inner and outer conductors vary from the nominal design, if plating quality is poor, or if contact separation at the junction is excessive, then the reflection coefficient and resistive loss at the interface will be degraded. For this reason, coaxial cable connections require bold contact between wiring elements. Current connections include threaded connectors with torque ratings for connection to precision instruments. The connection and de-connection processes are relatively time consuming, and often require tools to achieve a secure contact at the specified torque.

SUMMARY

According to an aspect of the inventive concepts, a magnetic cable connection device is provided that includes a cable connector and a magnetic switch. The magnetic switch includes diametrically magnetized first and second annular magnets juxtaposed in a longitudinal direction of the cable connector and extending around a longitudinal axis of the cable connector, and an annular magnetic guide of ferromagnetic material surrounding an outer periphery of the first and second annular magnets. The first annular magnet is fixed relative to the annular magnetic guide, and the second annular magnet is rotatable between ON and OFF positions relative to the annular magnetic guide. In the ON position the first and second annular magnets are magnetically aligned in the longitudinal direction, and in the OFF position the first and second annular magnets are magnetically inverted in the longitudinal direction.

The annular magnetic guide may include circumferential sections that are spaced from one another and aligned in the ON position over respective pole regions of the first and second annular magnets. The number of the circumferential sections of the annular magnetic guide may be the same as a number of poles of each of the first and second annular magnets.

The cable connector may be configured at one end to receive a coaxial cable and at another end to mate with another coaxial cable connector. The mating portion of the cable connector may protrude in the longitudinal direction from a radial end surface of the magnetic switch. Alternatively, the mating portion of the cable connector may be flush with the radial end surface of the magnetic switch.

Each of the annular magnets may be a one-piece annular magnetic body having opposite poles across a diameter of the annular magnetic body. Alternatively, each of the annular magnets may be an annular body having at least four sectors of alternating magnetic polarity around the longitudinal axis of the cable connector.

The magnetic cable connection device may further include an outer casing which houses the first and second annular magnets and the annular magnetic guide, as well as a rotation mechanism fixed to the second annular magnet for rotating the second annular magnet between the ON and OFF positions. The rotation mechanism may include a radially extending lever or a rotatable annular member extending around the longitudinal axis of the cable connector. The rotatable annular member may include a gripping section having an exposed outer surface portion, and a retention section fixed longitudinally between the gripping section and the second annular magnet. The casing may cover the annular magnetic guide adjacent the retention section.

According to another aspect of the inventive concepts, a coaxial connection is provided which includes a first coaxial magnetic cable connection device operatively coupled between a second coaxial magnetic cable connection device and a coaxial cable. The first coaxial magnetic cable connection device includes a first cable connector and a magnetic switch. The magnetic switch includes diametrically magnetized first and second annular magnets juxtaposed in a longitudinal direction of the first cable connector and extending around a longitudinal axis of the first cable connector, and an annular magnetic guide of ferromagnetic material surrounding an outer periphery of the first and second annular magnets. The second coaxial magnetic cable connection device includes a second cable connector and a plate of ferromagnetic material surrounding the second cable connector. The first and second annular magnets are magnetically aligned in the longitudinal direction and the magnetic switch of the first coaxial magnetic cable connection device is magnetically coupled to the plate of ferromagnetic material of the second coaxial magnetic cable connection device.

The first annular magnet may be fixed relative to the annular magnetic guide, and the second annular magnet may be rotatable between ON and OFF positions relative to the annular magnetic guide. In the ON position the first and second annular magnets may be magnetically aligned in the longitudinal direction, and in the OFF position the first and second annular magnets may be magnetically inverted in the longitudinal direction.

The annular magnetic guide may include circumferential sections that are spaced from one another and aligned over respective pole regions of the first and second annular magnets.

According to still another aspect of the inventive concepts, a cable connection adaptor is provided which includes a magnetic switch and first and second cable connectors. The first cable connector is configured for a threaded connection to a first coaxial element and the a second cable connector is coaxially coupled to the first cable connector through the magnetic switch. The second cable connector configured for a fitted connection to a second coaxial element. The magnetic switch magnetic switch includes diametrically magnetized first and second annular magnets juxtaposed in a longitudinal direction and extending around a longitudinal axis, and an annular magnetic guide of ferromagnetic material surrounding an outer periphery of the first and second annular magnets. The first annular magnet is fixed relative to the annular magnetic guide, and the second annular magnet is rotatable relative to the annular magnetic guide between ON and OFF positions. In the ON position the first and second annular magnets are magnetically aligned in the longitudinal direction, and in the OFF position the first and second annular magnets are magnetically inverted in the longitudinal direction.

The annular magnetic guide of the cable connection adaptor may include circumferential sections that are spaced from one another and aligned in the ON position over respective pole regions of the first and second annular magnets. The number of the circumferential sections of the annular magnetic guide may be the same as a number of poles of each of the first and second annular magnets.

BRIEF DESCRIPTION OF THE DRAWINGS

The above and other aspects and features of the inventive concepts will become readily apparent from the detailed description that follows, with reference to the accompanying drawings, in which.

DETAILED DESCRIPTION OF EMBODIMENTS

Embodiments of a magnetic cable connection device will now be described with reference to the schematic perspective views of the appended drawings. As will be explained in detail, the magnetic cable connection device of these examples includes a magnetic switch that is switchable between a magnetic ON position and a magnetic OFF position. In the magnetic ON position, the device exerts a magnetic attraction that can be utilized to securely fix the device to another magnetic cable connection device such as the connection jack of an electronic apparatus. The connection may be torqueless and can be made without threading and without tools. In the magnetic OFF position, the magnetic attraction is reduced or eliminated, thus allowing the magnetic cable connection device to be readily detached.

Figure 1:
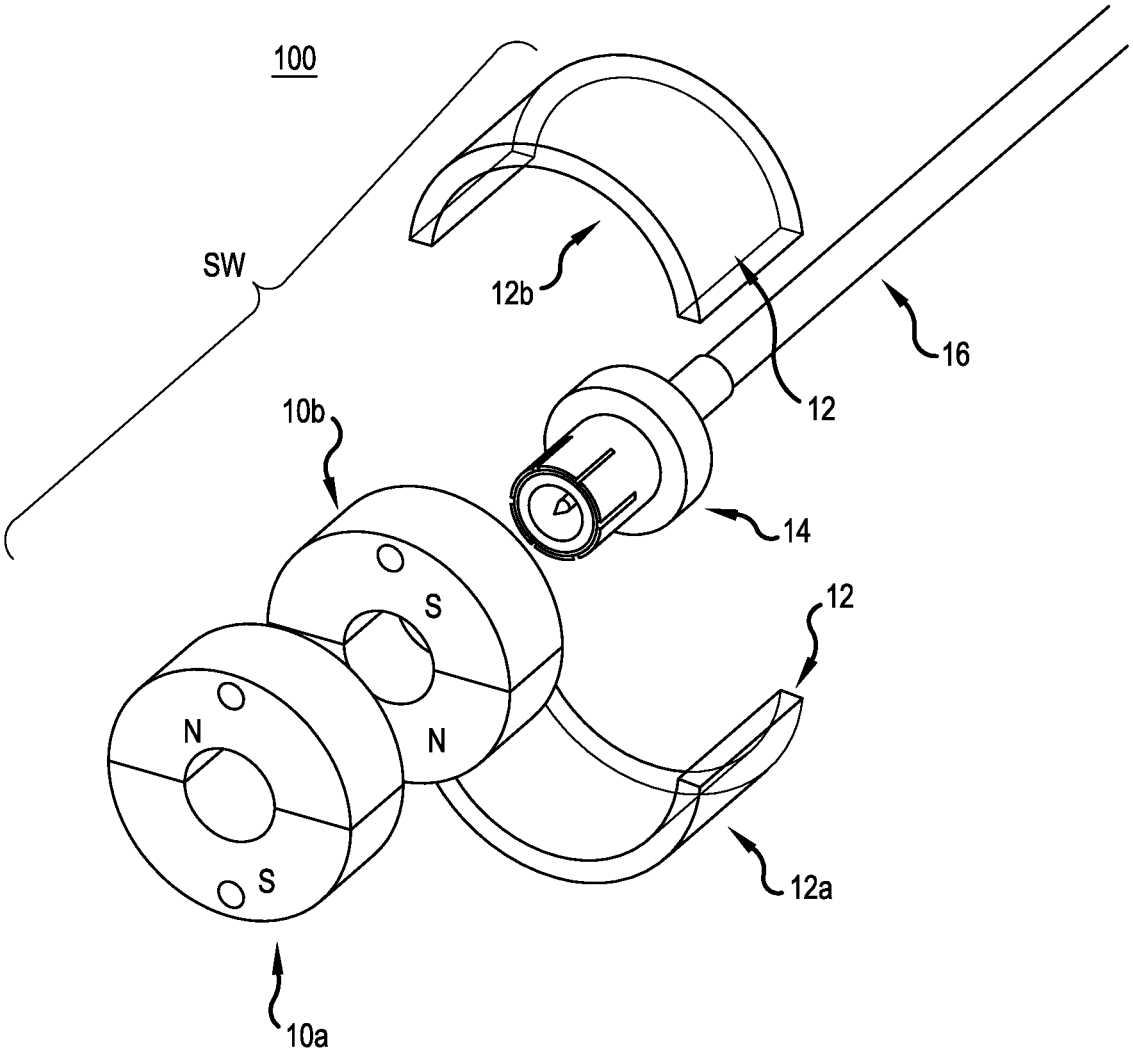
FIG. 1 is a breakaway schematic view of a magnetic cable connection device according to embodiments of the inventive concepts.
Figure 2A:
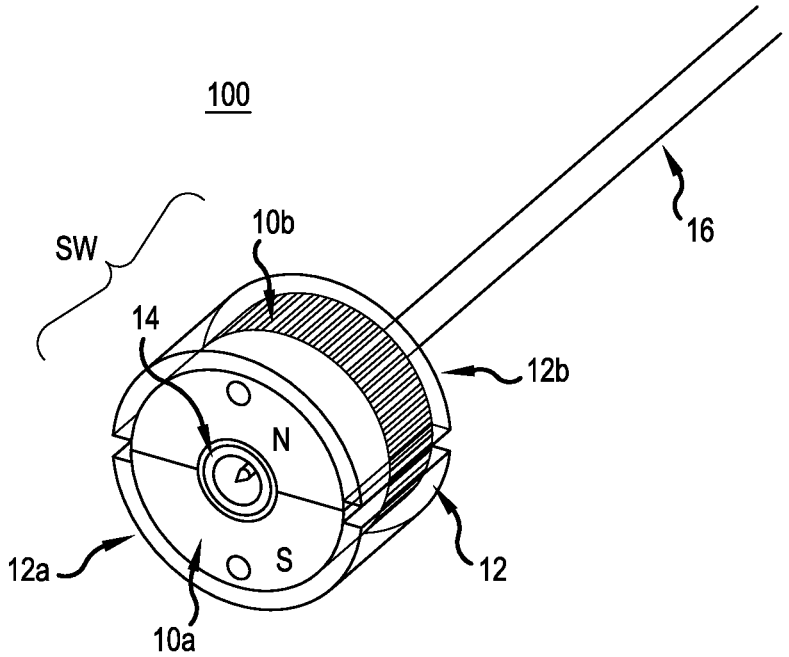
FIGS. 2A and 2B are schematic views of the magnetic cable connection device of FIG. 1 in magnetic OFF and ON positions, respectively.
Figure 2B:
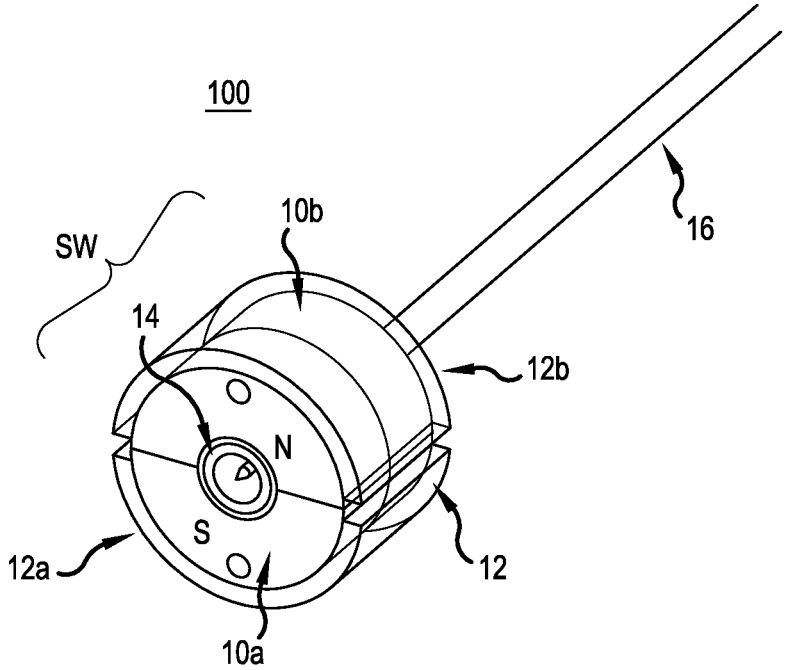

Referring initially and collectively to FIGS. 1, 2A and 2B, a magnetic cable connection device 100 according to an embodiment of the inventive concepts includes a coaxial cable connector 14 and a magnetic switch SW (10*a*, 10*b*, 12*a* and 12*b*). The coaxial cable connector 14 of the magnetic cable connection device 100 may be coaxially coupled to a coaxial cable 16. In addition, the coaxial cable connector 14 of the magnetic cable connection device 100 may be configured for a fitted connected to another magnetic coaxial cable connector or adaptor, examples of which is described later in connection with FIGS. 3, 8 and 15A-B. Here, the fitted connection may be torqueless and made without threads.

As shown in FIGS. 1, 2A and 2B, the magnetic switch SW of the example of this embodiment includes first and second annular magnets 10*a* and 10*b*, and an annular magnetic guide 12. The annular magnets 10*a* and 10*b* are juxtaposed in a longitudinal direction of the coaxial cable connector 14 and extend around a longitudinal axis of the magnetic cable connection device 100. As represented by the N (north) and S (south) sections in the figures, each of the annular magnets 10*a* and 10*b* is diametrically magnetized, i.e., each is a permanent magnet that is magnetized across its diameter. As will be explained later, a surface of the annular magnet 10*a* opposite the cable 16 constitutes an attaching surface of the magnetic cable connection device 100.

The illustrated embodiments show a preferred embodiment in which the inner periphery and outer periphery of the annular magnets 10*a* and 10*b* are circular and have the same dimensions. However, the inventive concepts are not limited in this manner. For example, the inner periphery may be any shape that allows for a cable and/or cable connector to pass there through, and that allows for rotation (explained later) of at least one of the first and second permanent magnets 10*a* and 10*b* about a longitudinal axis of the magnetic cable connection device 100. The shape of the outer peripheries of the annular magnets 10*a* and 10*b* is also not limited and may, for example, define polygonal cross-sections. Likewise, the size of one of the annular magnets 10*a* and 10*b* may be different than that of the other.

The magnetic switch SW is in the ON position when the first and second annular magnets 10*a* and 10*b* are magnetically aligned in the longitudinal direction, i.e., when poles N of the annular magnets 10*a* and 10*b* are aligned in the longitudinal direction and the poles S of the annular magnets 10*a* and 10*b* are aligned in the longitudinal direction (see FIG. 2B). On the other hand, the magnetic switch SW is in the OFF position when the poles of the first and second annular magnets 10*a* and 10*b* are magnetically inverted in the longitudinal direction (see FIG. 2A). Switching between the ON and OFF positions may be realized by 180° rotation of the first and second annular magnetics relative to each other.

Reference numbers 12*a* and 12*b* of FIGS. 1, 2A and 2B denote circumferential sections of the previously mentioned annular magnetic guide 12. The circumferential sections 12*a* and 12*b* are spaced apart from each other (e.g., with a gap and/or non-ferromagnetic material there between) and cover respective polar sectors along an outer periphery of the first and second annular magnets 10*a* and 10*b*. For example, in the ON position shown in FIG. 2B, the circumferential section 12*a* of the annular magnetic guide 12 covers the S-pole sectors of the annular magnets 10*a* and 10*b*, and the circumferential section 12*b* of the annular magnetic guide covers the N-pole sectors of the annular magnets 10*a* and 10*b*. Each circumferential section 12*a* and 12*b* is made of a ferromagnetic material and is operative to redirect a magnetic force to the attaching surface SA of the annular magnet 10*a* when the magnetic switch SW in in the ON position. That is, the annular magnets either attract or repel each other depending on their relative orientation (ON or OFF as described above). The side walls formed by the circumferential sections 12*a* and 12*b* encase the polar sectors of the annular magnets 10*a* and 10*b* to guide the magnetic field. When rotated into the ON position, the magnetic fields of the aligned polar sectors are combined in the side walls formed by the circumferential sections 12*a* and 12*b*. The device is thus magnetized and attracts a ferromagnetic counterpart in, for example, a connector jack. In this manner, the contacts are securely fixed. When the annular magnets 10*a* and 10*b* are aligned out phase as in FIG. 2A the resulting magnetic force of is reduced to a minimum, and the device is de-magnetized. The contacts can thus be easily detached from one another.

Figure 4:
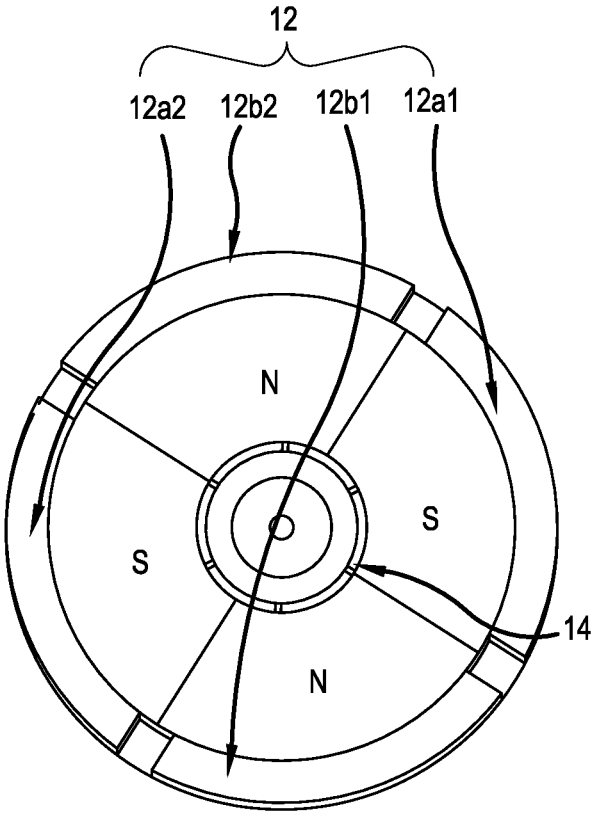
FIG. 4 is a plan view of a permanent magnet having four (4) poles and corresponding circumferential sections of an annular magnetic guide according to embodiments of the inventive concepts.

In an embodiment, the number of circumferential sections of the annular magnetic guide 12 is the same as the number of poles of each permanent magnet. In the example of FIGS. 1, 2A and 2B, each permanent magnet 10*a* and 10*b* has two pole sectors (N and S), and there are two corresponding circumferential sections 12*a* and 12*b* of the annular magnetic guide 12. Here, in this example, each of the annular magnets is a one-piece annular magnetic body having opposite poles across a diameter of the annular body. Alternatively, each of the permanent magnets may be an annular body having four or more sectors of alternating magnetic polarity around a central axis of the cable connector. FIG. 4 illustrates a plan view of an example in which each permanent magnet 10*a* or 10*b* includes four (4) pole sectors. Here, a corresponding number (4) of circumferential sections 12*a*1, 12*a*2, 12*b*1, and 12*b*2 of the annular magnetic guide 12 are provided.

The longitudinal gaps between the circumferential sections 12*a* and 12*b* of the annular magnetic guide 12 may be air gaps and/or filed with a non-ferromagnetic material. Also, a width in the longitudinal direction of the circumferential sections 12*a* and 12*b* may exceed a combined width in the longitudinal direction of annular magnets 10*a* and 10*b*. In some embodiments, the attaching surface of the first permanent magnet 10*a* is recessed relative to end surfaces of the circumferential sections 12*a* and 12*b*. In this case, as will be described in a later embodiment, it is the magnetized end surfaces of the circumferential sections 12*a* and 12*b* that make contact with the counterpart magnetic cable connection device.

The switching action of the magnetic cable connection device 100 according to an example embodiment will now be further described with reference to 2A and 2B.

According to embodiments of the inventive concepts, the second annular magnet 10*b* is rotatable about the longitudinal axis relative to the first annular magnet 10*a*. As such, the magnets 10*a* and 10*b* may be positioned in the OFF position in which the poles thereof are inverted (e.g., S-N and N-S as in FIG. 2A) in the longitudinal direction. By rotating one or both of the magnets 10*a* and 10*b* 180° relative to each other, they may be repositioned to the ON position in which the poles thereof are aligned (e.g., N-N and S-S as in FIG. 2B). In the ON position, as explained above, a relatively strong magnetic force becomes present at the attaching surface SA of the first permanent magnet 10*a*. As mentioned previously, the force of the aligned annular magnetics 10*a* and 10*b* is redirected by the annual magnetic guide 12 having circumferential sections 12*a* and 12*b* surrounding the aligned pole sections of the magnets. The result is an attractive magnetic force at end surfaces of the circumferential sections 12*a* and 12*b* surrounding the attaching surface of the first permanent magnet 10*a*.

In an embodiment of the inventive concepts, the first annular magnet 10*a* is fixed to the annular magnetic guide 12. That is, as represented in FIGS. 2A and 2B, the circumferential section 12*a* of the annular magnetic guide 12 is fixed over the S-pole sector of the annular magnet 10*a*, and the circumferential section 12*a* of the annular magnetic guide 12 is fixed over the N-pole sector of the annular magnet 10*a*. The circumferential sections 12*a* and 12*b* may be directly fixed to the first annular magnetic 10*a*, or indirectly fixed to the first annular magnet 10*a* (i.e., there may be one or more intervening material layers or gaps). On the other hand, in the embodiment, the second annular magnet 10*b* is rotatable between the circumferential sections 12*a* and 12*b* of the annular magnetic guide 12. As such, by rotation of the second annular magnet 10*b*, the magnetic switch can be set to the ON and OFF positions as described above.

Also in an embodiment of the inventive concepts, the cable connector 14 is configured at one end to receive a coaxial cable 16 and at another end to mate with another coaxial cable connector. The mating portion of the cable connector 14 may protrude in the longitudinal direction from the radial end surface of the magnetic switch SW. Alternatively, as shown in FIGS. 2A and 2B, the mating portion of the cable connector 14 may be flush with the radial end surface SA of the magnetic switch SW.

Figure 3:
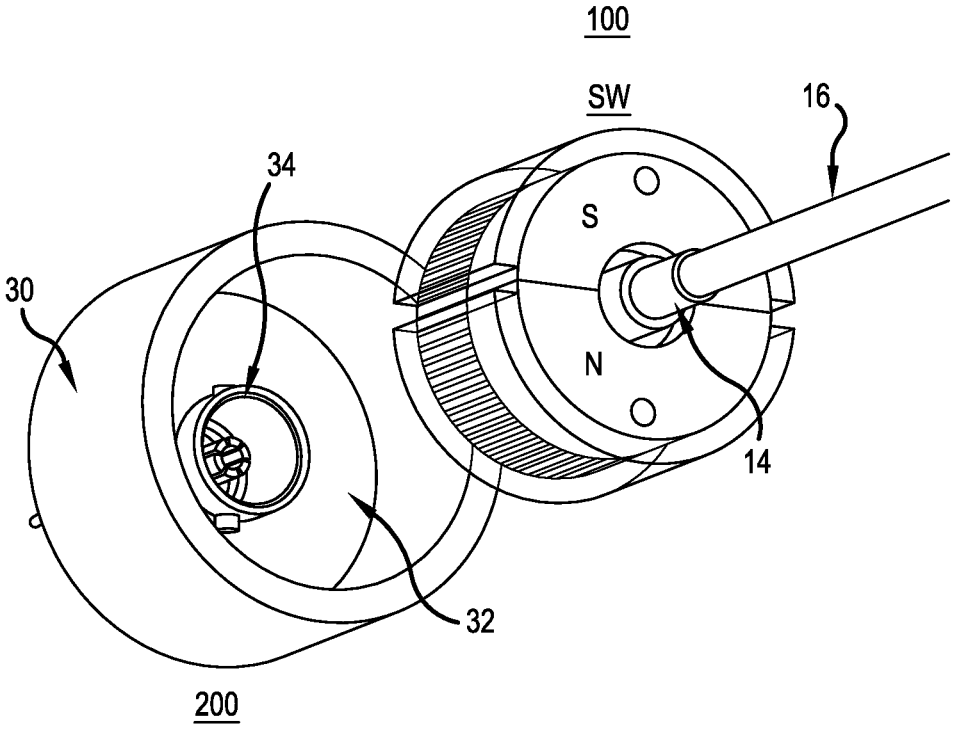
FIG. 3 is a schematic view of a counterpart magnetic cable connection device to which the magnetic cable connection device of FIG. 1 may be connected.

Reference is now made to FIG. 3 for reference in describing an example of a magnetic cable connection device 200 to which the magnetic cable connection device 100 may be connected. The magnetic cable connection device 200 may, for example, constitute an RF jack of an electronic device such as a signal analyzer.

As shown in FIG. 3, the magnetic cable connection device 200 includes a cable connector 34 and a plate 32 of ferromagnetic material surrounding the cable connector 34. The cable connector 34 is configured to mate with the cable connector 14 of the magnetic cable connection device 200 while the attachment surface of the magnetic switch SW of the magnetic cable connection device 100 is magnetically coupled to the plate 32. In this respect, the coupling between the cable connector 34 and the cable connector 14 may be a fitted connection (i.e., non-threaded connection). The fitted connection can be realized by insertion of the cable connector 14 into the cable connector 34, or by insertion of the cable connector 34 into cable connector 14. In words, either connector 14 or 34 can be a male connector while the other is a female connector. As another alternative, the fitted connection can be realized by planar contact between the cable connector 14 and the cable connector 34.

The magnetic cable connection device 200 of the example of FIG. 3 also includes a guide wall 30 surrounding the plate 32. The guide wall 30 may be provided to facilitate alignment of the connectors 14 and 34.

Figure 5:
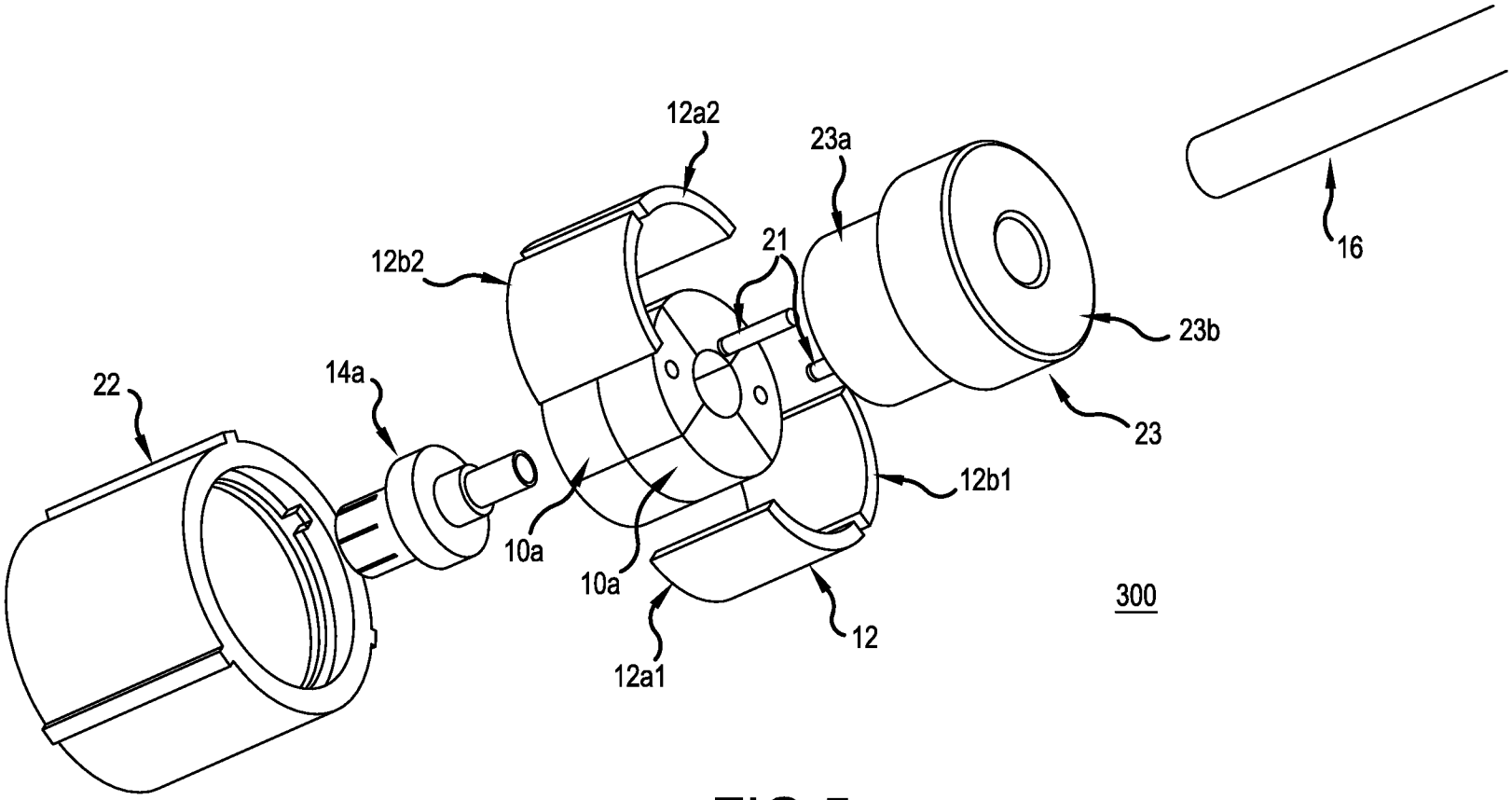
FIGS. 5, 6 and 7 are breakaway schematic views of a magnetic cable connection device including a housing and switch mechanism according to embodiments of the inventive concepts.
Figure 6:
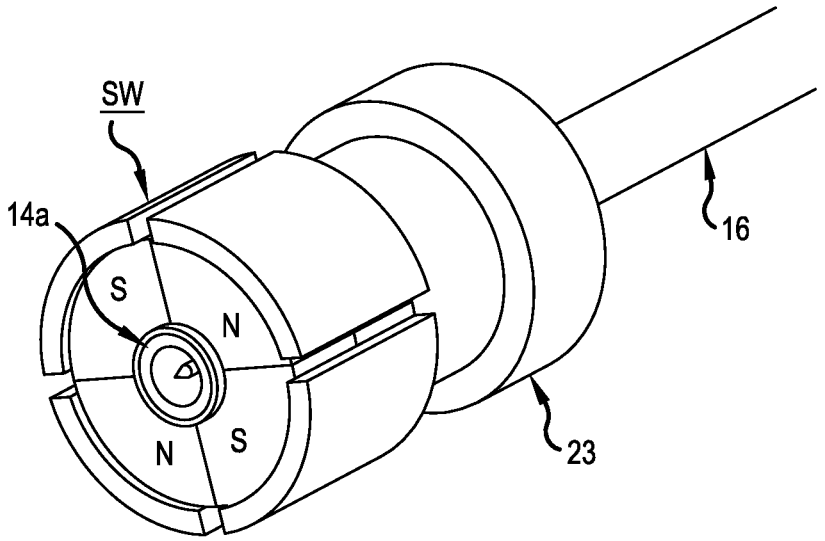
Figure 7:
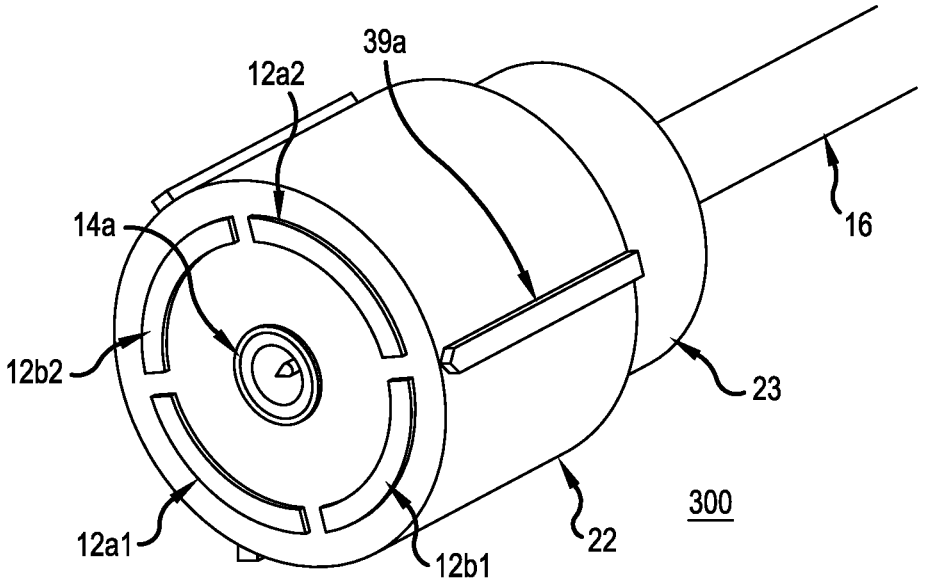

Another embodiment of the inventive concepts will now be described with reference to FIGS. 5 through 11. Here, reference will first be made to FIGS. 5 through 7, in which FIG. 5 is a breakaway perspective view of a magnetic cable connection device 300 according to this embodiment of the inventive concepts, FIG. 6 is a partially assembled perspective view of the magnetic cable connection device 300, and FIG. 7 is a fully assembled perspective view of the magnetic cable connection device 300. In these figures, like reference numbers refer to like elements of the previously described embodiments. A detailed description of such elements is omitted below to avoid redundancy in the description.

Referring collectively to FIGS. 5 through 7, the first and second annular magnets 10*a* and 10*b* each include four (4) polar sectors as shown. As such, in this embodiment, the magnetic annular guide 12 includes four (4) circumferential sections 12*a*1, 12*a*2, 12*b*1 and 12*b*2 such as that shown in previously described FIG. 4. In the example of this embodiment, the first annular magnetic 10*a* if fixed relative to the circumferential sections 12*a*1, 12*a*2, 12*b*1 and 12*b*2, while the second annular magnet is rotatable relative to the circumferential sections 12*a*1, 12*a*2, 12*b*1 and 12*b*2. It will be apparent that the magnetic switch is switched between ON and OFF positions by 90° of rotation of the first and second annular magnets 10*a* and 10*b* relative to each other.

Reference number 22 denotes an outer casing which covers the annular magnets 10*a* and 10*b* and the annular magnetic guide 12 (i.e., the circumferential sections 12*a*1, 12*a*2, 12*b*1 and 12*b*2). In addition, the outer casing 22 extends longitudinally over a narrow diameter portion 23*a* of a retention mechanism 23 which is rotatable about a longitudinal axis. As noted previously, the annular magnetic guide 12 (i.e., circumferential sections 12*a*1, 12*a*2, 12*b*1 and 12*b*2) may be fixed to first annular magnet 10*a*. Also in the current embodiment, the outer casing 22, the annular magnetic guide 12 and the first annular magnet 10*a* are fixed together in a fixed rotational position.

Separately, in the example of the illustrated embodiment, the outer casing 22 includes guide bars 39*a* which will be described later in connection with FIGS. 9A through 11.

In the example of this embodiment, the retention mechanism 23 includes the narrow diameter portion 23*a* and a wide diameter portion 23*b* juxtaposed in the longitudinal direction as shown in the figures. The narrow diameter portion 23*a* is fixed to the second annular magnet 10*b* by retaining rods 21 extending into confronting retaining holes located in the retention mechanism 23 and second annular magnet 10*b*. The wide diameter portion 23*b* may constitute a gripping member for either manually or robotically rotating the retention mechanism 23 (and thus the second annular magnet 10*b*) about the longitudinal axis. In this manner, the magnetic cable connection device 300 may be switched between magnetic ON and OFF positions.

Reference number 14*a* denotes a coaxial cable connector that extends into a center opening of the first and second annular magnets 10*a* and 10*b* so as to connect at one end to a coaxial cable 16. In the example of this embodiment, the coaxial cable 16 extends through a central opening in the retention mechanism 23 and is coupled to the cable connector within the center opening of the first and second annular magnets 10*a* and 10*b*. Also in the example of this embodiment, the other end of the cable connector 14*a* protrudes slightly past the end surface of the first annular magnet 10*a*. Likewise in this embodiment, the end surfaces of the circumferential sections 12*a*1, 12*a*2, 12*b*1 and 12*b*2 of the annular magnetic guide 12 protrude slightly past the end surface of the first annular magnet 10*a*.

As best seen in FIG. 7, the second outer casing 22 of this embodiment covers the end surface of first annular magnet 10*a*, but includes openings through which extend the protruding end surface of the cable connector 14*a* and the protruding end surfaces of the circumferential sections 12*a*1, 12*a*2, 12*b*1 and 12*b*2 of the annular magnetic guide 12. As such, in this embodiment, it is the end surfaces of the circumferential sections 12*a*1, 12*a*2, 12*b*1 and 12*b*2 of the annular magnetic guide 12 that magnetically contact with the ferromagnetic connecting plate of a counterpart magnetic cable connection device.

Figure 8:
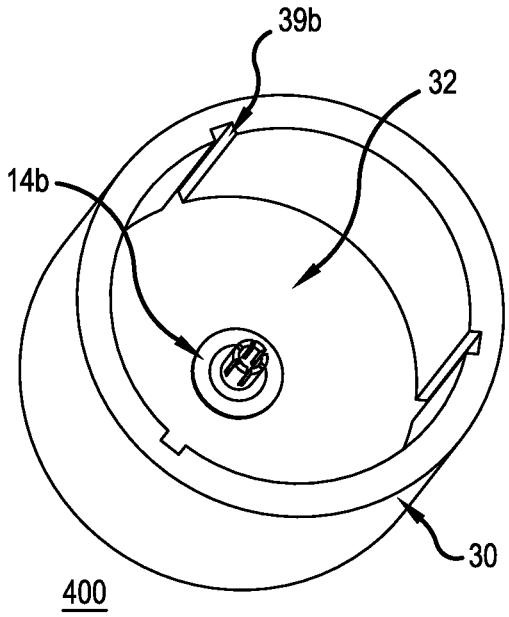
FIG. 8 is a schematic view of a counterpart magnetic cable connection device to which the magnetic cable connection device of FIGS. 5-7 may be connected.
Figure 9A:
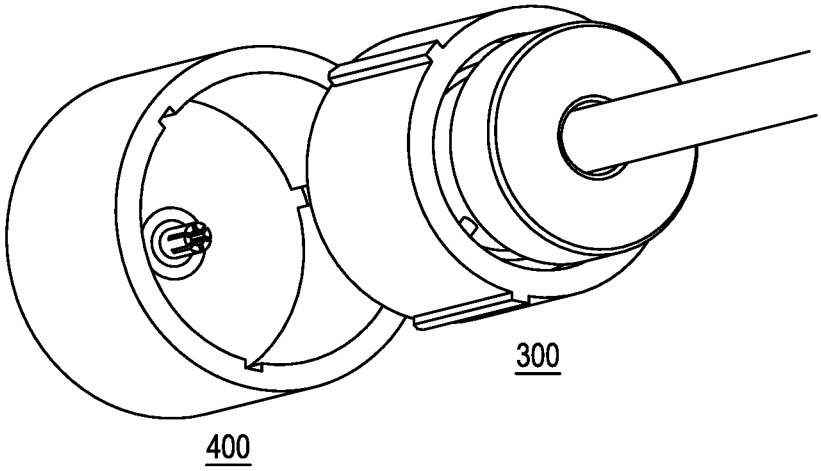
FIGS. 9A, 9B, 10 and 11 are schematic views for reference in describing the connection of the magnetic cable connection device of FIGS. 5-7 to the counterpart magnetic cable connection device of FIG. 8.
Figure 9B:
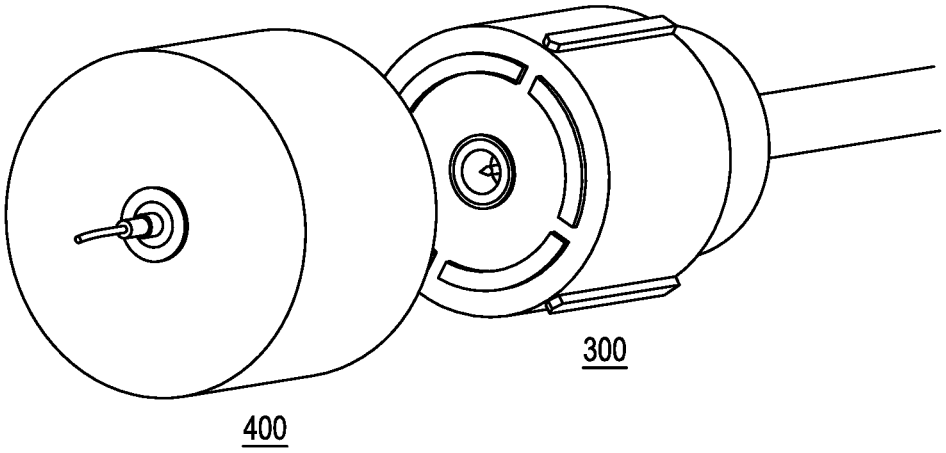
Figure 10:
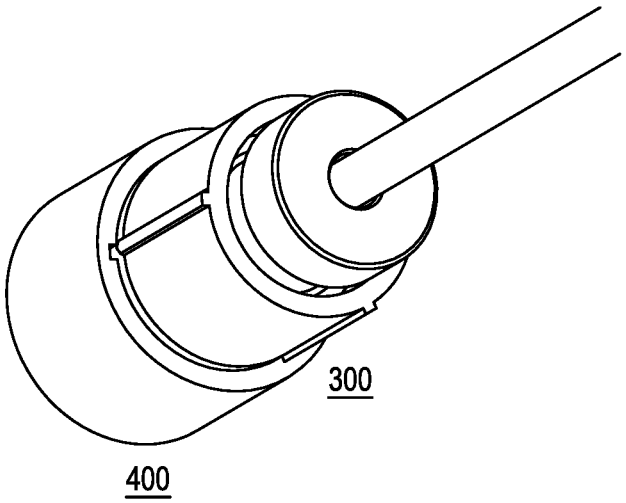
Figure 11:
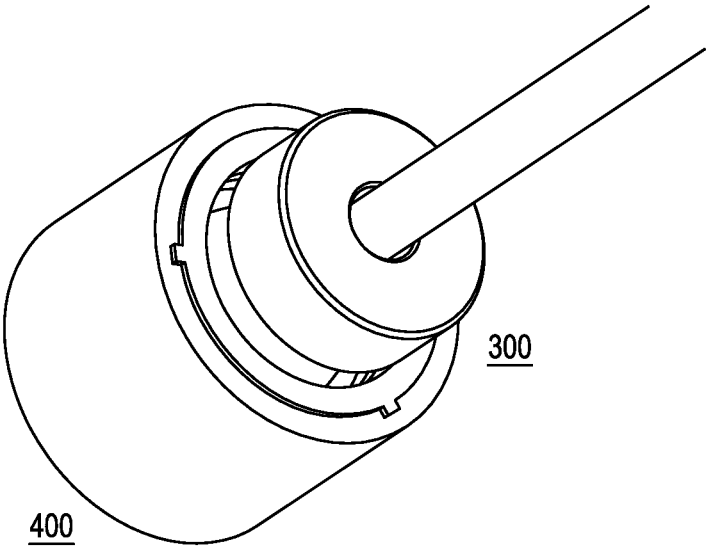

Reference is now made to FIG. 8 for reference in describing an example of a counterpart magnetic cable connection device 400 to which the magnetic cable connection device 300 may be connected. The magnetic cable connection device 400 may, for example, constitute an RF jack of an electronic device such as a signal analyzer.

As shown in FIG. 8, the magnetic cable connection device 400 includes a cable connector 14*b* and a plate 32 of ferromagnetic material surrounding the cable connector 14*b*, as well as a guide wall 30 surrounding the plate 32. The cable connector 14*b* is configured to mate with the cable connector 14*a* of the magnetic cable connection device 300 while the attachment surface of outer casing 22 of the magnetic cable connection device 300 is magnetically coupled to the plate 32. In this respect, the coupling between the cable connector 14*a* and the cable connector 14*b* may be a fitted connection (i.e., non-threaded connection). The fitted connection can be realized by insertion of the cable connector 14*a* into the cable connector 14*b*, or by insertion of the cable connector 14*b* into cable connector 14*a*. In the example associated with FIG. 8, a center conductor connector of the cable connector 14*b* is fitted into the cable connector 14*a* to make connection with a center conductor of cable connector 14*a*, while outer conductors of the cable connectors 14*a* and 14*b* make planar contact.

Separately, in the example of the illustrated embodiment, the guide wall 30 includes guide groves 39*b* which will be described next in connection with FIGS. 9A through 11.

FIGS. 9A, 9B, 10 and 11 are views illustrating stages of connection between the magnetic cable connection device 300 of FIGS. 5-7 and the magnetic cable connection device 400 of FIG. 8. Referring to these figures, connection may be achieved by placing the magnetic switch of the magnetic cable connection device 300 in the OFF position, inserting the magnetic cable connection device 300 into the guide wall 30 magnetic cable connection device 400 such that the ends of the annular magnetic guide 12 make contact with the ferromagnetic plate 32, and then switching the magnetic switch to the ON position to secure the magnetic cable connection device 300 in place. To inhibit rotation of the magnetic cable connection device 300 while operating the magnetic switch, the magnetic cable connection device 300 may include guide bars 39*a* inserted into guide groves 39*b* of the magnetic cable connection device 400.

Figure 12:
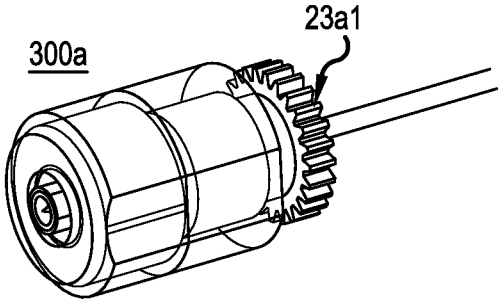
FIGS. 12, 13 and 14 are schematic views of switching mechanisms that may be used to switch a magnetic cable connection device between ON and OFF positions according to embodiments of the inventive concepts.
Figure 13:
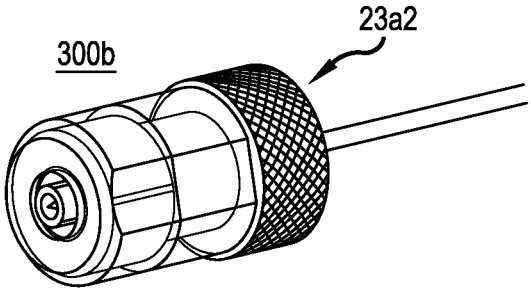
Figure 14:
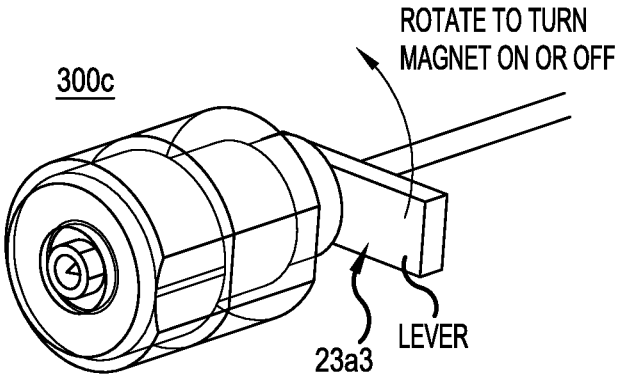

FIGS. 12, 13 and 14 are perspective views of magnetic cable connection devices 300*a-c* having alternative rotation mechanisms. In particular, FIG. 12 illustrates an example in which an outer surface of the retention mechanism includes gear cogs. Gear cogs may be particularly useful for driving the magnetic switching mechanism robotically. FIG. 13 illustrates an example in which an outer surface of the rotation mechanism is gnarled to facilitate gripping either manually or by mechanical mechanisms. FIG. 14 illustrates an example in which the rotation mechanism is implemented by a radially extending lever. In some embodiments, the rotation mechanisms are manually operated (rotated). In other embodiments, the rotation mechanisms are automatically rotated for example by robotic devices.

Figure 15A:
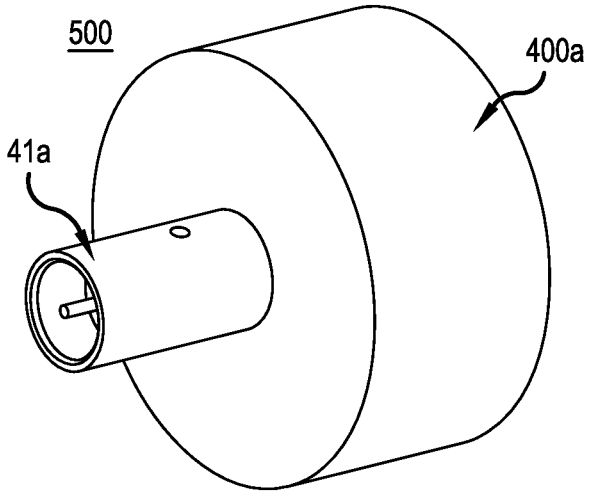
FIGS. 15A, 15B 15C and 15D are schematic views for reference in describing a magnetic cable connection adaptors according to embodiments of the inventive concepts.

Attention is now directed to the perspective views of FIGS. 15A-5C for reference in describing cable connection adaptors 500 and 600 according to embodiments of the inventive concepts. The adaptors 500 and 600 are configured to connect a magnetic cable connector to a standard cable connector located at the end of a coaxial cable or on an electronic device. In this manner, the magnetic cable connector can advantageously be used to magnetically attach and detach the cable or device to another connector as described in the previous embodiments.

Figure 15B:
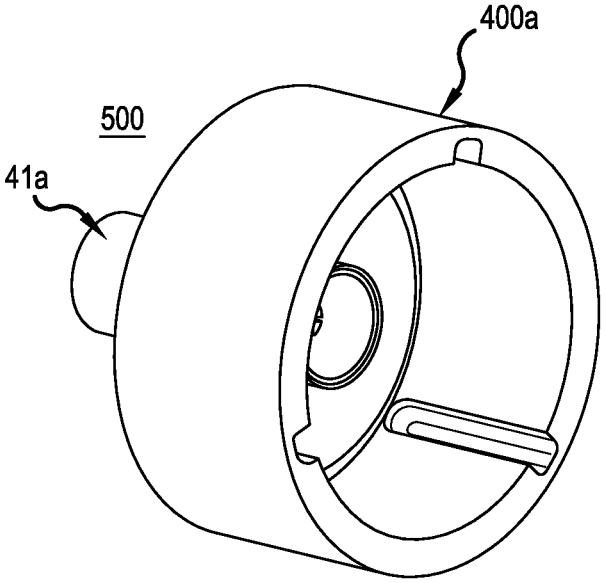

As shown in FIGS. 15A-15B, the cable connection adaptor 500 is configured of a device 400*a* which may be the same as the cable connection device 400 of previously described FIG. 8, except that the device 400*a* is equipped with a cable connector 41*a* located opposite to a connecting surface of the ferromagnetic plate of the cable connection device 400. The cable connector 41*a* may be a standard threaded cable connector. As such, the cable connection adaptor 500 can be attached to a standard coaxial cable or jack, thus adapting the cable or jack for connection to a magnetic switch cable connection device such as that described above in connection with FIGS. 5-7.

Figure 15C:
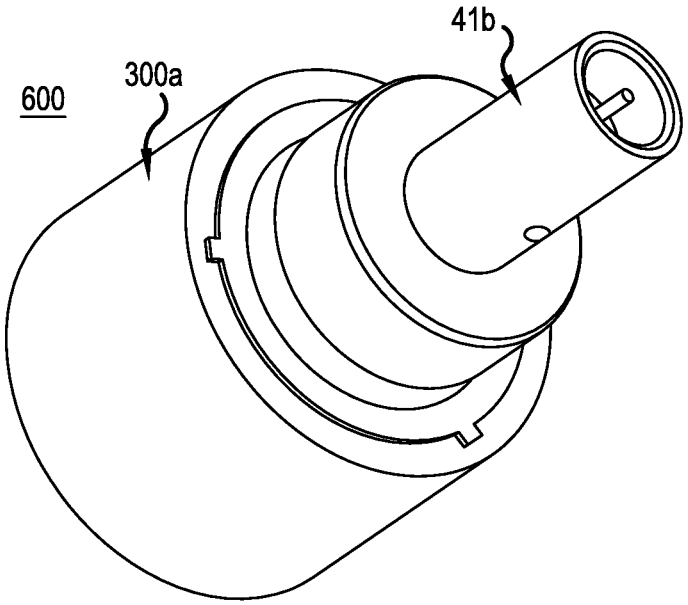
Figure 15D:
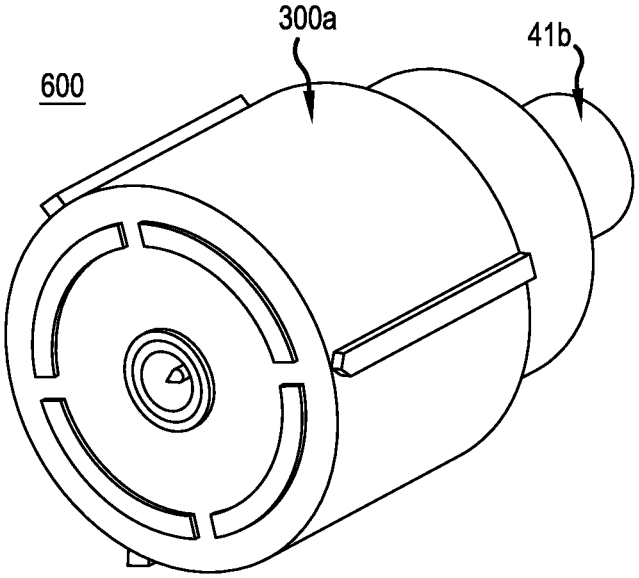

FIGS. 15C and 15D illustrate a cable connection adaptor 600 that is configured of a device 300*a* which may be the same as the magnetic cable connection device 300 of previously described FIG. 5-7, except that the device 300*a* is equipped with a cable connector 41*b* located at the external face of the retention mechanism 23 of the magnetic cable connection device 300. The cable connector 41*b* may be a standard threaded cable connector. As such, the cable connection adaptor 600 can be attached to a standard coaxial cable or jack, thus adapting the cable or jack for connection to a magnetic cable connection device having a ferromagnetic plate such as that described above in connection with FIG. 8.

FIGS. 16A through 16D are schematic views for describing a number of different coaxial connection scenarios according to embodiments of the inventive concepts.

Figure 16A:
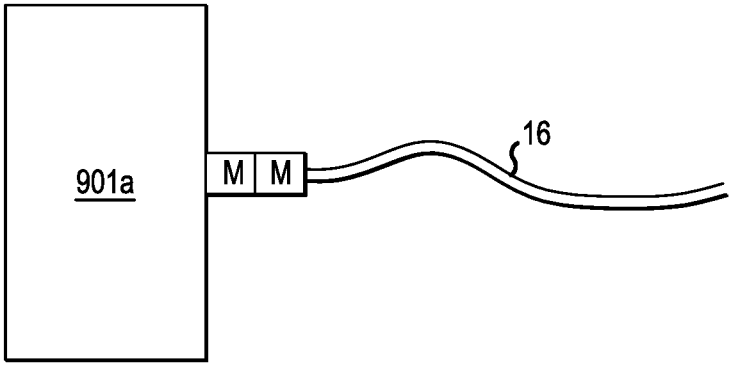
FIGS. 16A, 16B, 16C and 16D are block diagrams representing different connection configurations to electronic apparatus using the magnetic cable connection devices and/or adaptors according to embodiments of the inventive concepts.

Referring to FIG. 16A, reference number 901*a* denotes an electronic apparatus. Examples of the electronic apparatus 901*a* include oscilloscopes, analyzers, measurement devices, source generators, power generators, modular instruments, network emulators, and entertainment systems such as televisions and cable/satellite boxes. However, the electronic apparatus 901*a* is not limited to these examples, and may be any device having one or more coaxial cable connectors.

Still referring to FIG. 16A, the electronic apparatus 901*a* of this example is equipped with a magnetic cable connection device M. Typically, but not necessarily, the magnetic cable connection device (M) will be located at a housing surface of the electronic apparatus 901*a*. Also in the example of FIG. 16A, a coaxial cable 16 is equipped at one end with a magnetic cable connection device M.

In some embodiments of the inventive concepts, the magnetic cable connection device M of the electronic apparatus 901*a* of FIG. 16A is configured with a ferromagnetic plate connector such as the magnetic cable connection device 400 described previously in connection with FIG. 8. In this case, the magnetic cable connection device M of the coaxial cable 16 may be configured with a magnetic switch such as the magnetic cable connection device 300 described in connection with previously described FIGS. 5-7. Alternatively, in other embodiments of the inventive concepts, the magnetic cable connection device M of the cable 16 is configured as a ferromagnetic plate connector, and the magnetic cable connection device M of the electronic apparatus 901*a* is configured as a magnetic cable connection device including a magnetic switch.

Figure 16B:
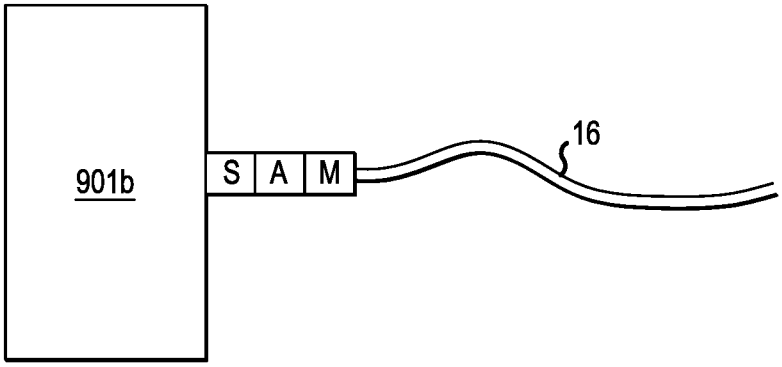

FIG. 16B illustrates an example in which the electronic apparatus 901*b* includes a "standard" (S) cable connector. For example, the standard cable connector S may be a threaded connector such as an SMA (SubMiniature version A) GH SMA or FME (For Mobile Equipment) connector. On the other hand, the coaxial cable 16 is equipped at one end with a magnetic cable connection device M. As such, an adaptor A is coupled to the standard cable connector S to allow from magnetic connection of the cable 16 to the device 901*b*.

In some embodiments of the inventive concepts, the adaptor A connected to the standard cable connector S of the electronic apparatus 901*b* of FIG. 16B is configured with a ferromagnetic plate connector such as the adaptor 500 of previously FIGS. 15A and 15B. In this case, the magnetic cable connection device M of the coaxial cable 16 may be configured as a magnetic cable connection device including a magnetic switch as in the embodiments of FIGS. 5-7 described above. Alternatively, in other embodiments of the inventive concepts, the magnetic cable connection device M of the cable 16 is configured with a ferromagnetic plate connector, and the adaptor A is configured with a magnetic switch such as the adaptor 600 of FIGS. 15C and 15D.

Figure 16C:
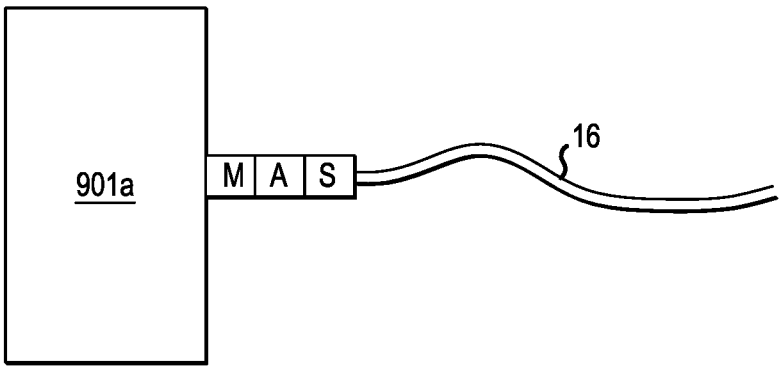

FIG. 16C illustrates an example in which the electronic apparatus 901*a* includes a magnetic cable connection device M, and the cable 16 to be connected to the electronic apparatus 901*c* includes a "standard" (S) cable connector. As such, an adaptor A is coupled to the standard cable connector S of the cable 16 to allow for magnetic connection of the cable 16 to the device 901*b*.

In some embodiments of the inventive concepts, the adaptor A connected to the standard cable connector S of the cable 16 of FIG. 16C is configured with a magnetic switch such as in the adaptor 600 of previously described FIGS. 15C and 15D. In this case, the magnetic cable connection device M of the electronic apparatus may be configured with a ferromagnetic plate connector such as magnetic cable connection device 400 described previously in connection with FIG. 8. Alternatively, in other embodiments of the inventive concepts, the adaptor A connected to the cable 16 is configured with a ferromagnetic plate connector like the adaptor 500 of previously described FIGS. 15A and 15B, and the magnetic cable connection device M is configured as with a magnetic switch such as the magnetic cable connection device 300 of FIGS. 5-7.

Figure 16D:
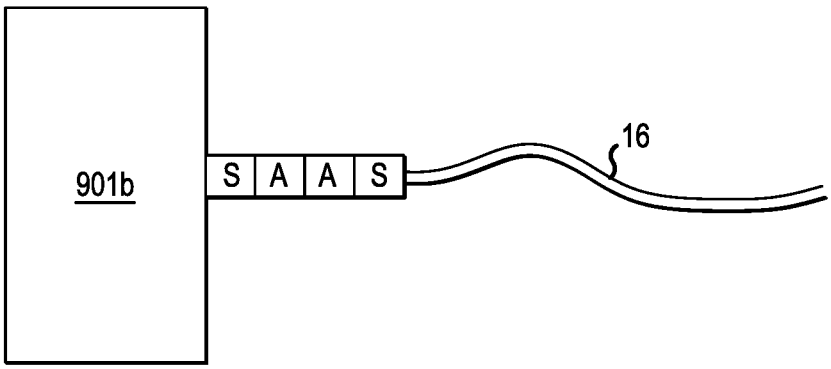

FIG. 16D illustrates an example in which both the electronic apparatus 901*b* and the cable 16 include standard cable connectors S. In this case, each is equipped with an adaptor A to allow for magnetic connection between the apparatus 901*b* and the cable 16.

In some embodiments of the inventive concepts, the adaptor A connected to the standard cable connector S of the electronic apparatus 901*b* of FIG. 16D is configured with a ferromagnetic plate connector such as the adaptor 500 described previously in connection with FIGS. 15A and 15B. In this case, the adaptor A connected to the coaxial cable 16 may be configured with a magnetic switch such as in the adaptor 600 of previously described FIGS. 15C and 15D. Alternatively, in other embodiments of the inventive concepts, the adaptor A of the cable 16 is configured with a ferromagnetic plate connector, and the adaptor A of the apparatus 901*b* is configured with a magnetic switch.

While the invention has been illustrated and described in detail in the drawings and foregoing description, such illustration, and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims. While representative embodiments are disclosed herein, one of ordinary skill in the art appreciates that many variations that are in accordance with the present teachings are possible and remain within the scope of the appended claim set. The invention therefore is not to be restricted except within the scope of the appended claims.

What is claimed is:

1. A cable connection device comprising:

a cable connector comprising a center conductor; and a magnetic switch including diametrically magnetized first and second annular magnets juxtaposed in a longitudinal direction of the cable connector and extending around a longitudinal axis of the cable connector, and an annular magnetic guide of ferromagnetic material surrounding an outer periphery of the first and second annular magnets, the annular magnetic guide comprising circumferential sections comprising alternating magnetic polarity that are spaced from one another and aligned in the ON position over respective pole regions of the first and second annular magnets, wherein the first annular magnet is fixed relative to the annular magnetic guide, and the second annular magnet is rotatable between ON and OFF positions relative to the annular magnetic guide, wherein in the ON position the first and second annular magnets are magnetically aligned in the longitudinal direction, and in the OFF position the first and second annular magnets are magnetically inverted in the longitudinal direction, and an opening exists between the first and second annular magnets, and the center conductor is disposed in the opening.

2. The cable connection device of claim 1, wherein a number of the circumferential sections of the annular magnetic guide is the same as a number of poles of each of the first and second annular magnets.

3. The cable connection device of claim 1, wherein the cable connector is configured at one end to receive a coaxial cable and at another end to mate with another coaxial cable connector.

4. The cable connection device of claim 3, wherein a mating portion of the cable connector protrudes in the longitudinal direction from a radial end surface of the magnetic switch.

5. The cable connection device of claim 3, wherein a mating portion of the cable connector is flush with a radial end surface of the magnetic switch.

6. The cable connection device of claim 1, wherein each of the annular magnets is a one-piece annular magnetic body having opposite poles across a diameter of the annular magnetic body.

7. The cable connection device of claim 1, wherein each of the annular magnets is an annular body having at least four sectors of alternating magnetic polarity around the longitudinal axis of the cable connector.

8. The cable connection device of claim 1, further comprising an outer casing which houses the first and second annular magnets and the annular magnetic guide.

9. The cable connection device of claim 1, further comprising a rotation mechanism fixed to the second annular magnet for rotating the second annular magnet between the ON and OFF positions.

10. The cable connection device of claim 9, wherein the rotation mechanism includes a radially extending lever.

11. The cable connection device of claim 9, wherein the rotation mechanism includes a rotatable annular member extending around the longitudinal axis of the cable connector.

12. The cable connection device of claim 11, wherein the rotatable annular member comprises:

a gripping member having an exposed outer surface portion; and a retention mechanism fixed longitudinally between the gripping member and the second annular magnet.

13. The cable connection device of claim 12, further comprising an outer casing which houses the first and second annular magnets and the annular magnetic guide and which at least partially covers the retention mechanism of the rotatable annular member.

14. The cable connection device of claim 1, wherein a non-ferromagnetic material exists in between the circumferential sections.

15. A coaxial connection comprising a first coaxial cable connection device operatively coupled between a second coaxial cable connection device and a coaxial cable, the first coaxial cable connection device including a first cable connector and a magnetic switch, the magnetic switch including diametrically magnetized first and second annular magnets juxtaposed in a longitudinal direction of the first cable connector and extending around a longitudinal axis of the first cable connector, and an annular magnetic guide of ferromagnetic material surrounding an outer periphery of the first and second annular magnets, the annular magnetic guide comprising circumferential sections comprising alternating magnetic polarity that are spaced from one another and aligned over respective pole regions of the first and second annular magnets, and the second coaxial cable connection device including a second cable connector and a ferromagnetic plate surrounding the second cable connector, wherein the first and second annular magnets are magnetically aligned in the longitudinal direction and the magnetic switch of the first coaxial cable connection device is magnetically coupled to the ferromagnetic plate of the second coaxial cable connection device, and an opening exists between the first and second annular magnets, and is adapted to receive a center conductor therein.

16. The coaxial connection of claim 15, wherein the first annular magnet is fixed relative to the annular magnetic guide, and the second annular magnet is rotatable between ON and OFF positions relative to the annular magnetic guide, and wherein in the ON position the first and second annular magnets are magnetically aligned in the longitudinal direction, and in the OFF position the first and second annular magnets are magnetically inverted in the longitudinal direction.

17. The coaxial connection of claim 15, wherein a non-ferromagnetic material exists in between the circumferential sections.

18. A cable connection adaptor, comprising:

a magnetic switch;

a first cable connector, the first cable connector configured for a threaded connection to a first coaxial element; and a second cable connector coaxially coupled to the first cable connector through the magnetic switch, the second cable connector configured for a fitted connection to a second coaxial element;

a magnetic switch including diametrically magnetized first and second annular magnets juxtaposed in a longitudinal direction and extending around a longitudinal axis, and an annular magnetic guide of ferromagnetic material surrounding an outer periphery of the first and second annular magnets, the annular magnetic guide comprising circumferential sections comprising alternating magnetic polarity that are spaced from one another and aligned in an ON position over respective pole regions of the first and second annular magnets, wherein an opening exists between the first and second magnets, and is adapted to receive a center conductor therein, wherein the first annular magnet is fixed relative to the annular magnetic guide, wherein the second annular magnet is rotatable relative to the annular magnetic guide between ON and OFF positions, and wherein in the ON position the first and second annular magnets are magnetically aligned in the longitudinal direction, and in the OFF position the first and second annular magnets are magnetically inverted in the longitudinal direction.

19. The cable connection adaptor of claim 18, wherein a number of the circumferential sections of the annular magnetic guide is the same as a number of poles of each of the first and second annular magnets.

20. The cable connection adaptor of claim 18, wherein a non-ferromagnetic material exists in between the circumferential sections.

* * * * *